United States Patent [19]

Shaffer et al.

[11] 3,986,765

[45] Oct. 19, 1976

[54] POWER CORD CONNECTOR

[75] Inventors: Howard Richard Shaffer, Harrisburg; Robert Houston Frantz, Carlisle; John Aaron Zimmerman, Jr., Hershey, all of Pa.

[73] Assignee: AMP Incorporated, Harrisburg, Pa.

[22] Filed: Feb. 7, 1975

[21] Appl. No.: 548,047

[52] U.S. Cl. ..... 339/90 R; 339/94 A; 339/103 R; 339/126 RS; 339/187

[51] Int. Cl.[2] ..... H01R 7/32

[58] Field of Search..... 339/90, 103, 89, 187–189, 339/126, 128

[56] References Cited

UNITED STATES PATENTS

| | | | |
|---|---|---|---|
| 2,701,348 | 2/1955 | Horn | 339/90 R |
| 2,787,770 | 4/1957 | Arson | 339/90 R |
| 2,933,711 | 4/1960 | Eaton | 339/90 R |
| 3,020,516 | 2/1962 | Despard | 339/103 R |
| 3,437,980 | 4/1969 | Smith | 339/103 R |
| 3,840,839 | 10/1974 | Smaczny et al. | 339/90 R |

FOREIGN PATENTS OR APPLICATIONS

| | | | |
|---|---|---|---|
| 1,092,983 | 11/1967 | United Kingdom | 339/90 R |

*Primary Examiner*—Roy Lake
*Assistant Examiner*—Neil Abrams
*Attorney, Agent, or Firm*—Russell J. Egan

[57] ABSTRACT

A power cord connector is disclosed for detachably connecting an electric power cord to an electrically operated device, which can include all types of appliances, tools and the like. The connector is used to connect a single power cord with any number of separate devices and provides a fast and positive bayonet type locking and unlocking engagement therewith. The connector also provides strain relief for the power cord and guards the cord and extensions against sharp bends and high stress flexing. The connector is polarized and can be adapted for multi-wire configurations. The receptacle portion of the connector can be formed integral with the device, formed as a separate drop in member, or formed for panel mounting.

16 Claims, 12 Drawing Figures

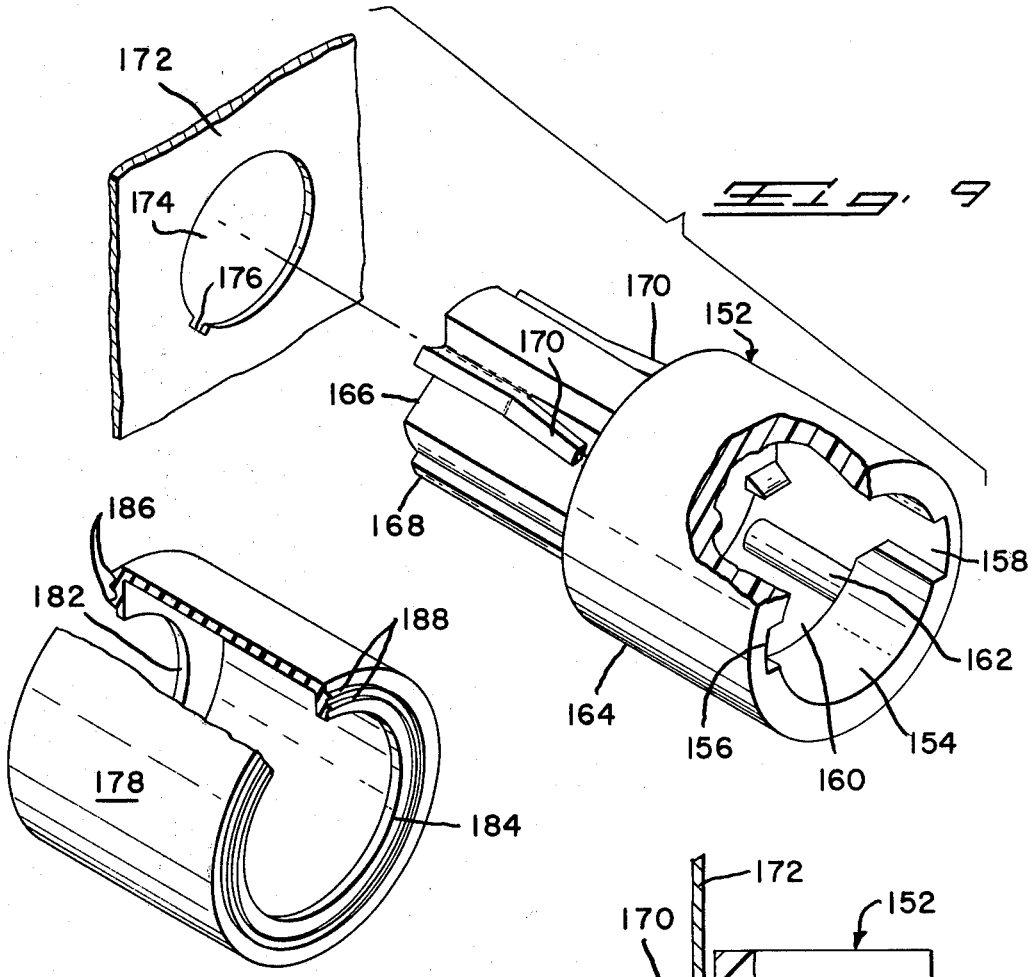
Fig. 9
Fig. 11
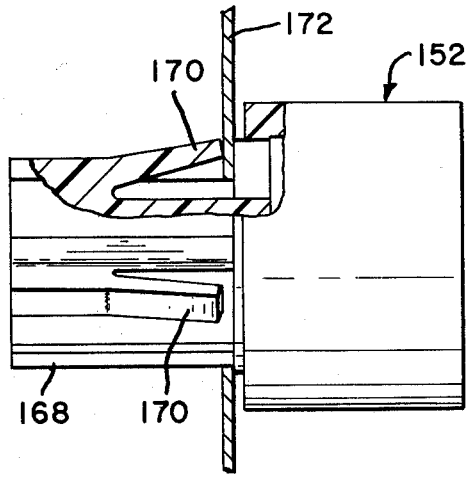
Fig. 10
Fig. 12
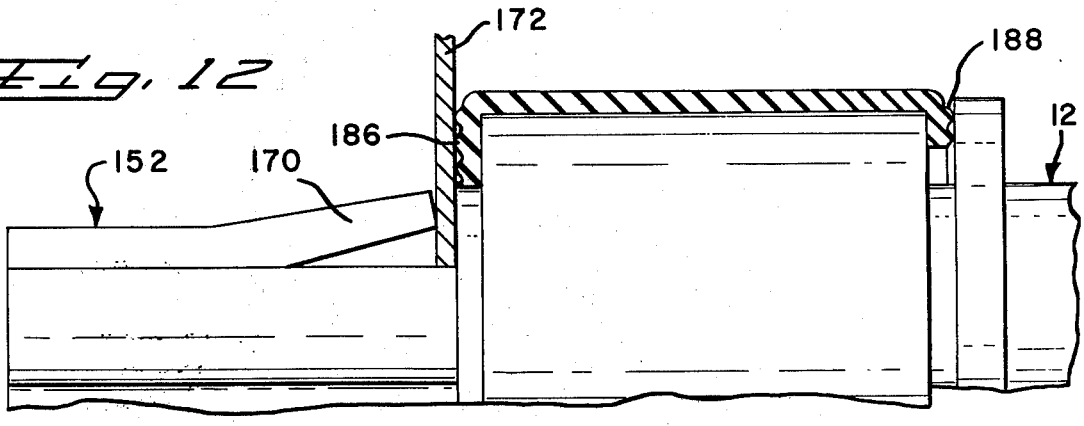

POWER CORD CONNECTOR

BACKGROUND OF THE INVENTION 1. The Field Of The Invention

The present invention relates to a power cord connector and in particular to a connector for detachably engaging a single power cord with any number of separate electrically operated devices. 2. The Prior Art Until recently almost all electrically operated devices, such as appliances, powered hand tools, and the like, have been provided with a permanently attached power cord or cable. Many such power cords, especially those for large tools, are of heavy crosssection and are difficult to fold into a storage container or tool box along with the appliance or tool. Also the average person accumulates more than one electrically operated device, and thus gets a substantial inventory of electric power cords which represents a sizeable investment. Recently the manufacturers of electrical devices, such as appliances and tools, have been interested in providing removable power cord sets of standard design which may be interchanged with different electrically powered devices. Such removable power cord sets must be capable of making good electrical connection and also be easily removable, but not liable to be accidentally disengaged.

The types of electrical devices which may apply the interchangeable power cord principle of the present invention include the more traditionally male operated devices such as electrically powered tools including drills, sanders, saws, and the like, and the more traditionally female operated devices such as hair dryers and all types of kitchen appliances including toasters, mixers, and the like. This is, of course, only a partial listing and is not intended to exclude other related areas, such as home entertainment equipment, industrial control cabinets and electronic testing devices.

Examples of detachable power cord connectors which are known in the prior art are represented, for example, by U.S. Pat. No. 2,947,966; 2,988,724 and 3,843,224, all of which relate to a locking connector for portable electric tools; 3,054,080, which relates to an electric fry pan type of appliance; 3,309,113, which is intended for use with tubular members; and 2,787,770; 3,177,464; 3,551,880; and 3,594,696, all of which relate to quick disconnect, multiple terminal connectors.

SUMMARY OF THE INVENTION

The present invention is directed towards a novel detachable electric power cord set for an electrically operated device. The subject power cord set includes a pair of cooperating members, namely, a receptacle member mounted in the device and a plug member fixed on a free end of a power cord or cable, the other end of which is adapted to be plugged into a conventional power source or to a further power cord. The receptacle and plug members include bayonet type, retaining means to releasably secure the plug and receptacle members together. The connector also includes cable strain relief means, guard means preventing stressing of the cable and contacts, polarizing means, and means to adapt the connector for multiple wire operation. The receptacle member can be formed in two further embodiments, one of which is insertable into a device to be so modified for use with the subject power cord connection, and the other of which is insertable into a panel aperture. Sealing means can also be provided to make an environmental tight seal about the subject connector, especially when panel mounted.

It is therefore an object of the present invention to produce an improved power cord connector which is simple in structure, inexpensive to manufacture, and yet will provide reliable performance with safe and positive interconnection. It is another object of the present invention to produce a power cord connector which can be used to connect a standardized power cord and any number of separate electrically powered devices, such as tools and appliances.

It is still another object of the present invention to produce a power cord connector adapted for making mating engagement between an electrical power cord and an electrically operated device with positive locking therebetween.

It is yet another object of the present invention to produce a power cord connector wherein a twisting action is necessary to effect locking and unlocking of the mating members.

It is a further object of the present invention to produce a power cord connector with positive locking means which allow rotation of a portion of a plug member with respect to the remaining portion of itself to effect a locking action with a corresponding receptacle member.

It is a still further object of the present invention to produce a power cord connector which can be operated from outside of a housing to effect positive locking mating between a power cord and an electrically operated device.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 3 is an exploded perspective view of the plug member of the subject power cord connector;

FIG. 9 is an exploded perspective view of a panel mount embodiment of the receptacle member of the subject invention;

FIG. 10 is a side elevation, partially in section, showing the panel mount receptacle member of FIG. 9 fully inserted into a panel, FIG. 11 is a perspective view, partially in section, of a seal to be employed with the panel mount receptacle member of FIGS. 9 and 10; and FIG. 12 is a side elevation, partially in section, showing the seal of FIG. 11 in position on the panel mounted receptacle member of FIGS. 9 and 10.

DETAILED DESCRIPTION OF THE INVENTION

Figure 1:
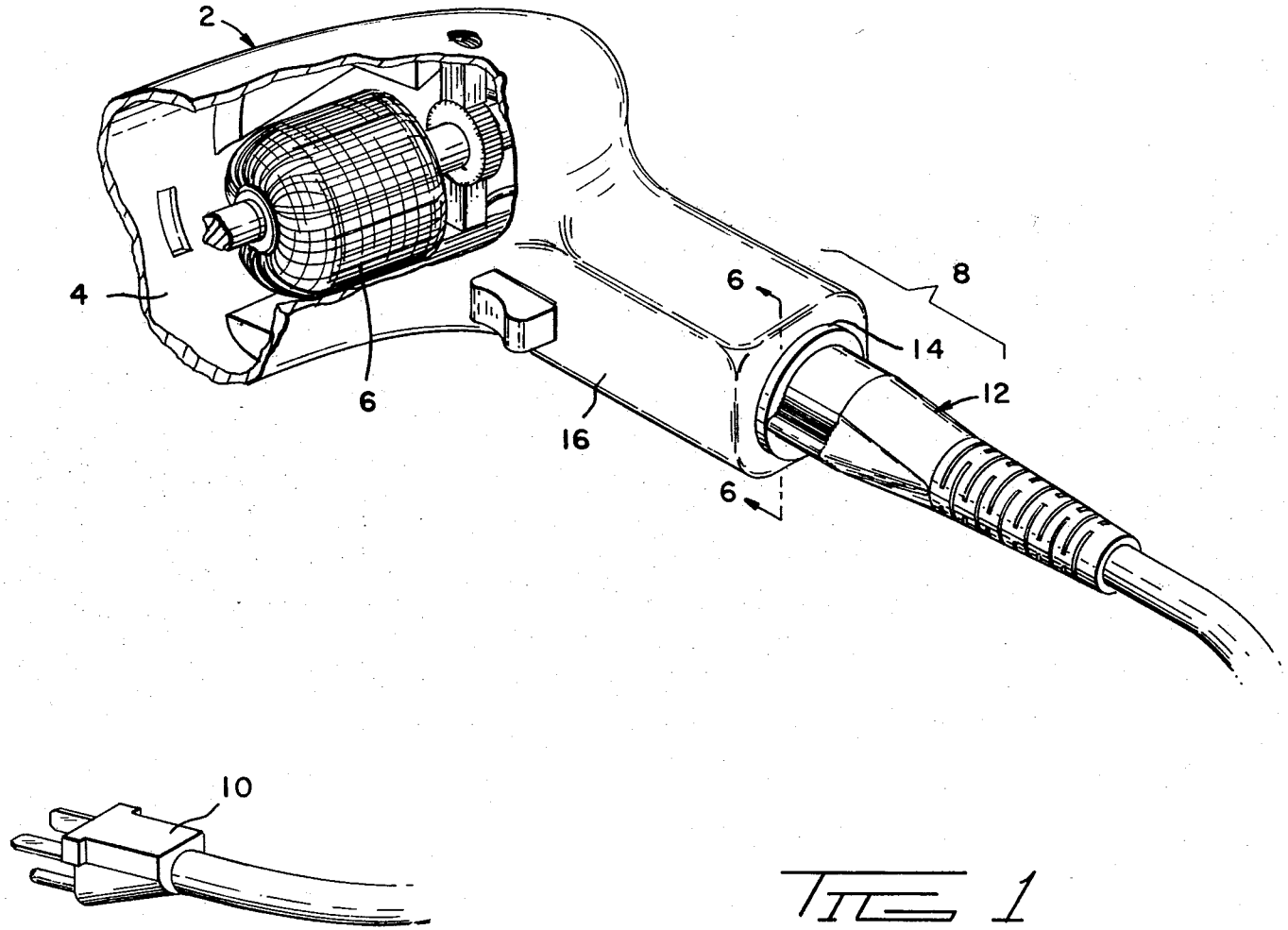
FIG. 1 is a perspective view, partially in section, of a typical hand tool provided with the subject power cord assembly.
Figure 2:
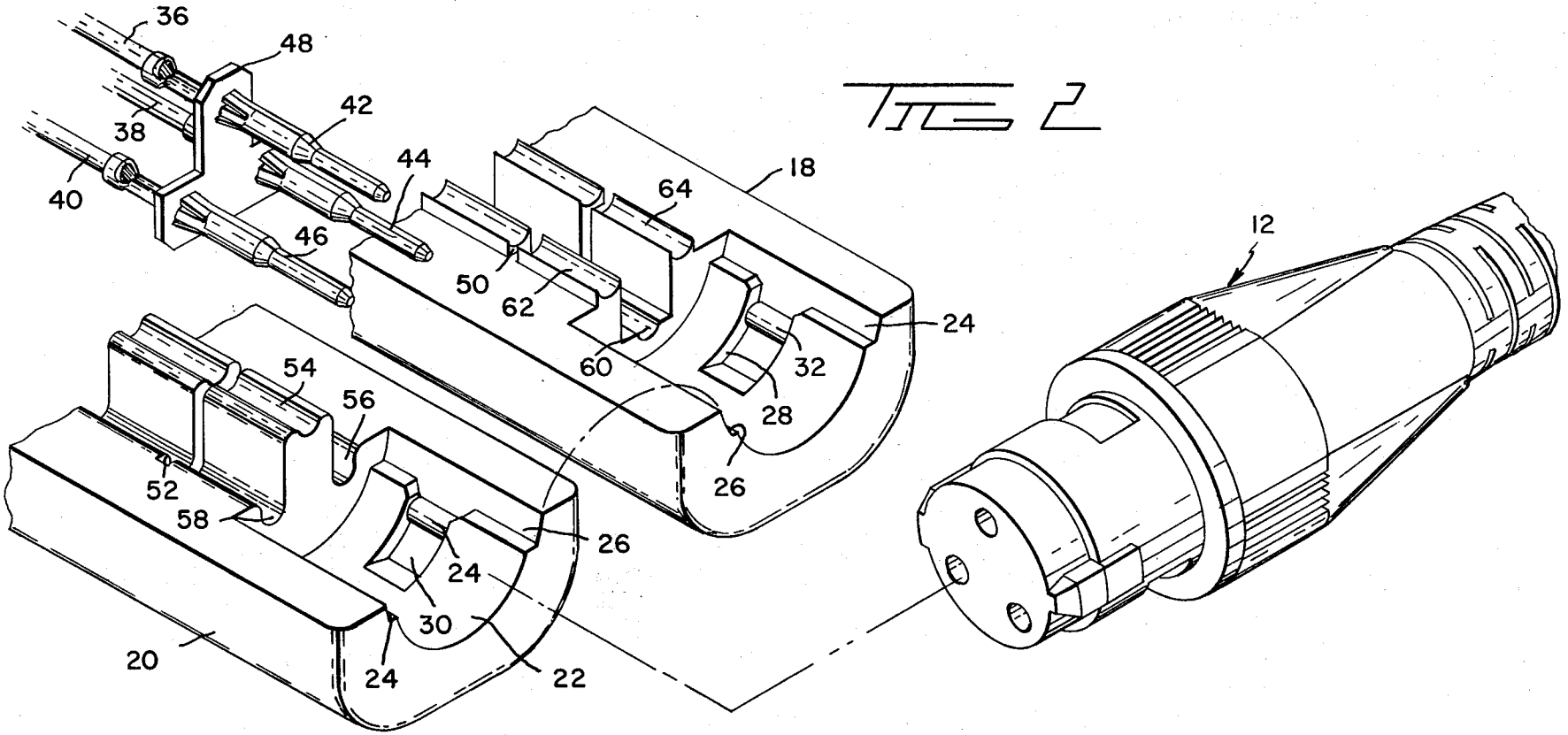
FIG. 2 is an exploded perspective view of the power cord receptacle member with the plug member disconnected therefrom.

The subject power cord connector can be used with any type of electric power operated device as mentioned above. Examples of suitable devices cover a wide range of products from well known power tools such as drills, sanders, saws and the like, to hairdryers, vacuums and kitchen appliances of all types. This list is intended as merely illustrative and not restrictive of the type devices which can be used with the subject connector. The primary requirement for suitability use of the subject connector would be simply an electrically operated device which would probably be used in a convenient location along with a number of similar devices and where it is desired to eliminate the expenses and bothersome clutter of having a plurality of power cords, each permanently attached to a respective one of the devices. Thus the subject connector will be described with relation to an electrically operated device which will remain unnamed and only a handle portion of which will be shown and described. A typical tool is shown in FIG. 1 with the subject power cord connector assembly attached thereto. The tool 2 includes a housing 4 which encloses a motor 6 all of which are conventional and is adapted to receive the power cord assembly 8 therein. The power cord assembly includes a conventional two or three prong plug 10 on one end and the opposite end is provided with a plug member 12 mated with and locked in a receptacle member 14, which is formed as an integral portion of tool handle 16. The plug member 12 is shown in FIG. 2 disengaged from the receptacle member 14 and the tool handle 16 opened to reveal the inner profile of the housing shells 18, 20. The housing shells 18, 20, when mated, define therebetween a blind, substantially cylindrical passageway 22 including a pair of diametrically opposite channels 24, 26 extending the length of the passageways. One of the channels, in this case channel 24, is wider than the other for polarization purposes. Locking recesses 28, 30 each having a detent 32, 34 integral therewith, extend about the periphery of the passageway extending substantially normal from the respective channels 24, 26. The embodiment shown is for three wire operation with the wires 36, 38, and 40 connected to respective pin terminals 42, 44, 46 and held in parallel spaced arrangement in a planar retaining member 48. The retaining member 48 is received in grooves 50, 52 in the housing shells 18, 20, respectively, with the individual pin terminals lying in respective recesses 54, 56, 58 in housing shell 20. The contacts are held in position in these recesses by backing profiles 60, 62, 64 respectively of the mating housing shell 18.

Figure 4:
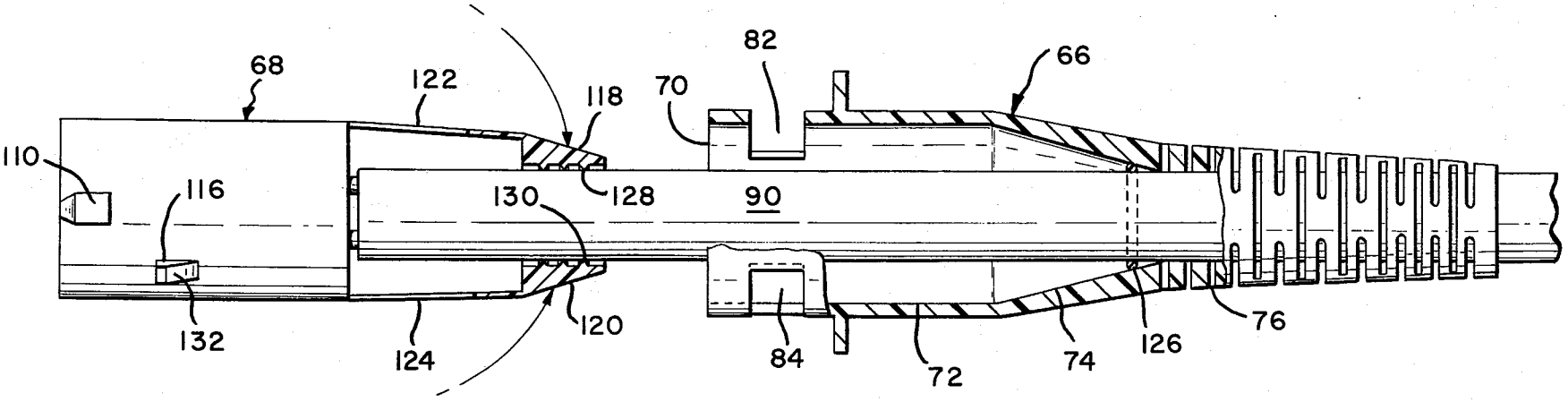
FIG. 4 is a side elevation, partially in section, showing the plug member of the subject power cord connector in a partially assembled condition.
Figure 5:
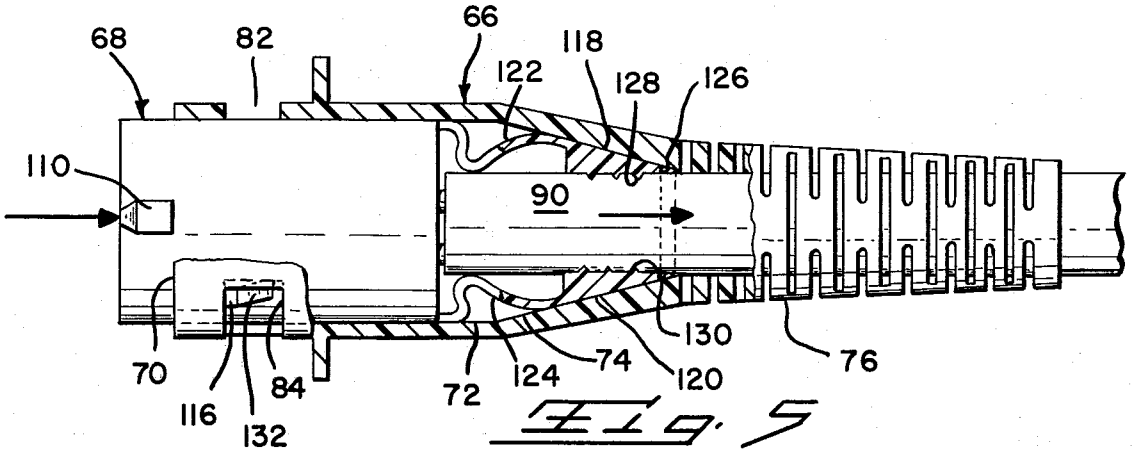
FIG. 5 is a view similar to FIG. 4 showing the fully assembled plug member of the power cord connector.

Turning now to FIGS. 3 to 5, the plug member 12 shown in an exploded condition in FIG. 3 to reveal its two main components, namely a plug housing 66 and a plug body 68. The plug housing 66 has a central passageway which starts at annular opening 70, extends through a cylindrical portion 72 to a tapered portion 74 and finally to a profiled integral cord guard portion 76 of known slotted configuration. A pair of outwardly directed locking flanges 78, 80 are integral with the cylindrical portion 72 and immediately adjacent opening 70. Spaced to the rear of the flanges 78, 80 are a pair of elongated apertures 82, 84 extending about the periphery of the cylindrical portion. The plug housing 66 can further be provided with an integral outwardly directed radial flange 86, and a profiled, roughened gripping surface 88 to facilitate the rotational movement required for locking and unlocking of the plug.

The power cable 90 extends through a central passageway in the plug housing 66 and is shown with three wires 92, 94, and 96 each terminated with an appropriate receptacle terminal 98, 100, 102. The terminals 98, 100, 102 are adapted to be received in a molded plug body 68 having through bores 104, 106, 108, outwardly directed profiled flanges 110 and 112, locking projections 114, 116 and strain relief gripping members 118, 120 each of which is connected to the body 68 by a respective flexible connector to the body 68 by a respective flexible connector 122, 124. The flanges 110 and 112 correspond in thickness to flanges 78, 80, respectively on the plug housing 66 in order to polarize the plug member for mating with the receptacle member. The front end of the flanges 110 and 112 is profiled in order to facilitate insertion of the plug member into the receptacle member.

The plug body 68 is assembled with the plug housing 66 as shown in FIGS. 4 and 5. Also shown in these Figures is an optional sealing O-ring 126 which is positioned on the cable 90. The receptacle terminals 98, 100, 102 are inserted into their respective bores 104, 106, 108 and the strain relief members 118, 120 are brought into engagement with the cable 90 as shown in FIG. 4. Ridges 128, 130 of the strain relief members make a biting engagement into the insulation of the cable 90 when the plug body is fully received in the plug housing. The plug body 68 and plug housing 66 are moved axially towards one another. The locking projections 114, 116 have an inclined rear surface 132 which will cam open the opening 70 allowing the projections to pass through to engage in the apertures 82, 84, respectively, as shown in FIG. 5. It should be noted that the slots 82, 84 are substantially greater in length about the periphery of the plug than the dimensions of the locking projections 114, 116. Thus the plug body 68 and the plug housing 66 can be rotated with respect to each other about their common axis.

Figure 7:
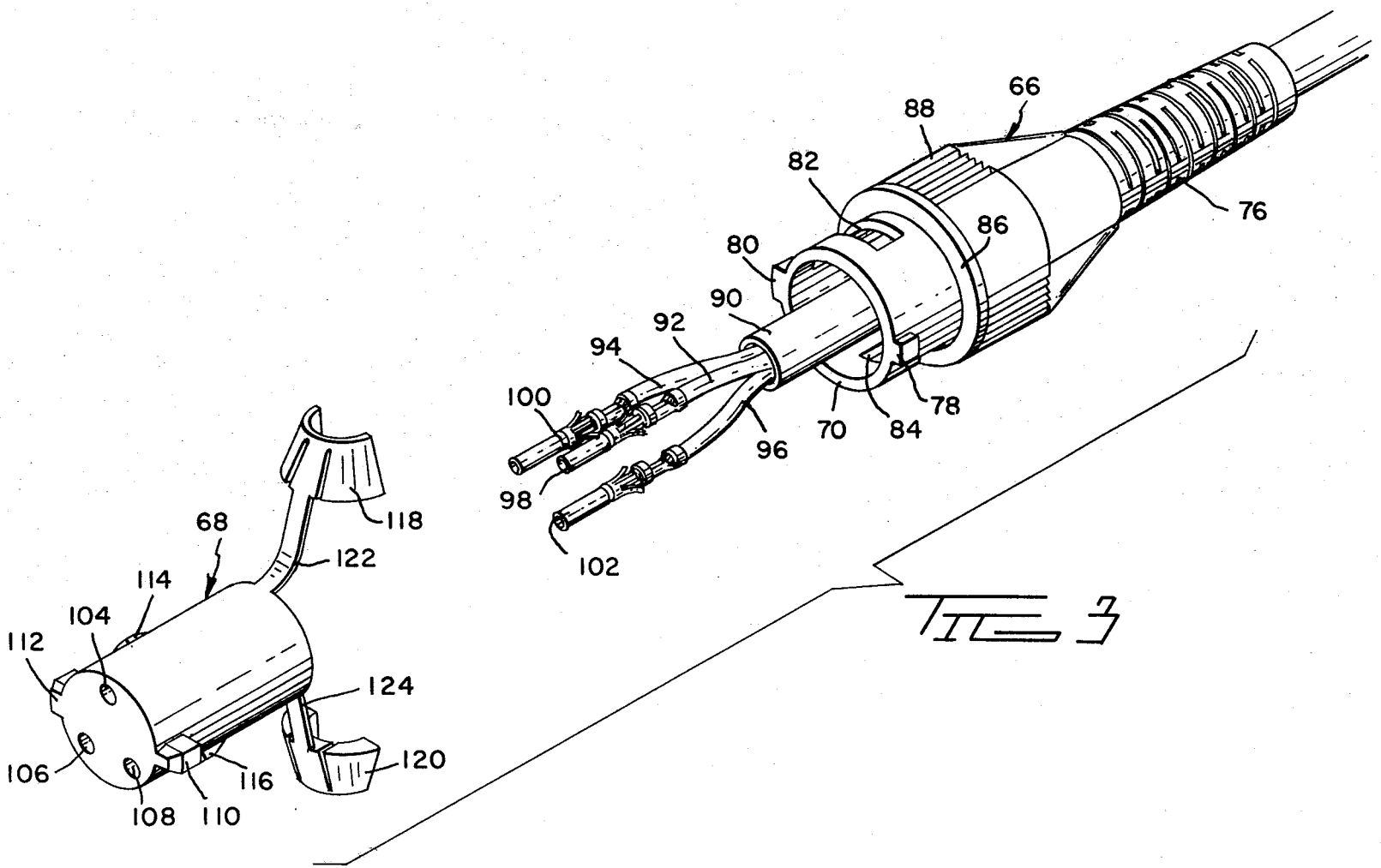
FIG. 7 is a view similar to FIG. 6 showing the connector in a fully locked condition.
Figure 6:
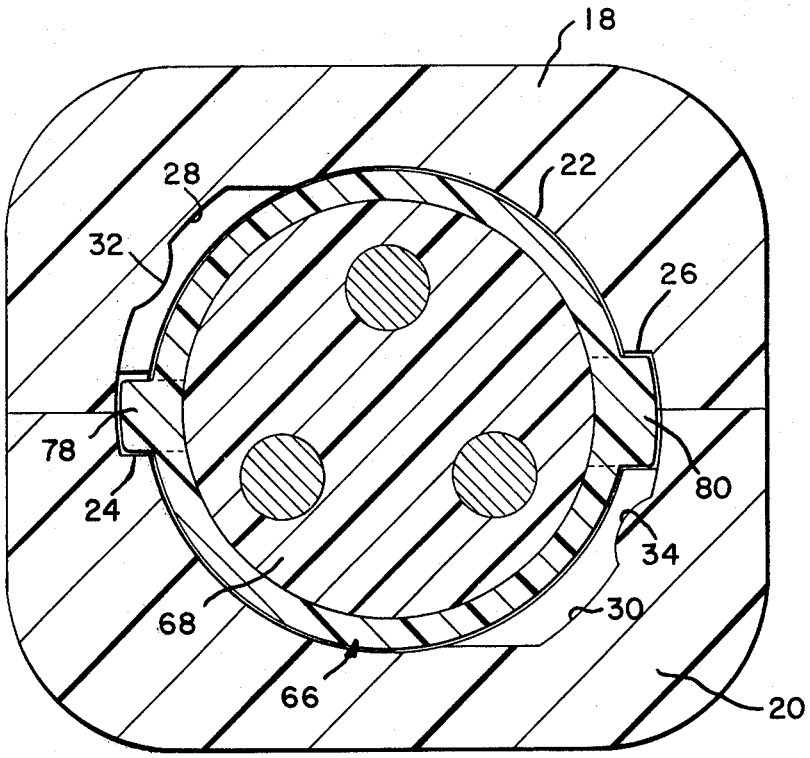
FIG. 6 is a transverse section taken along line 6—6 of FIG. 1 showing the connector in the mated but unlocked position.
Figure 7:
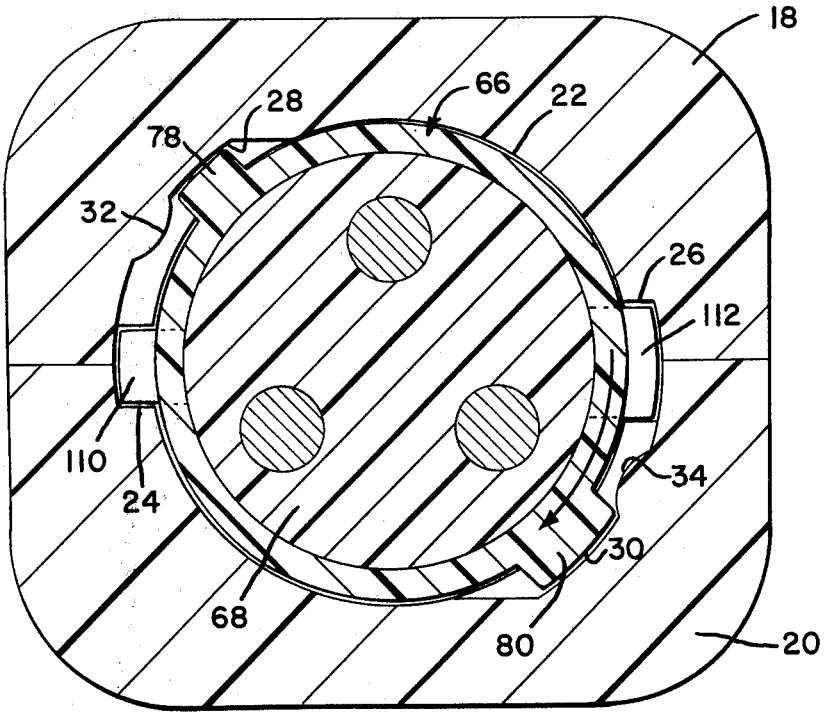

The operation of the locking the plug member into the receptacle member can best be seen from FIGS. 6 and 7. FIG. 6 show the flanges 78, 80 aligned with respect to flanges 110, 112, respectively for insertion into the channels 24, 26 of the receptacle member. Polarization of the connector by having flanges on opposite sides of the connector of different sizes is best illustrated in these Figures. When the plug member 12 is fully inserted into the receptacle member 14 the plus housing 66 is rotated with respect to the plug body 68. The plug body 68 is, of course, held in position with respect to the receptacle member 14 by the engagement of the receptacle terminals 98, 100, 102 with respective pin terminals 42, 44, 46. Rotation of the plug housing 66 drives the flanges 78, 80 beyond the respective detents 32, 34 of the locking recesses 28, 30, thus the power cord set will be securely held in the device.

It should also be noted from FIG. 5 that the O-ring 126 makes an effective seal of the plug when the plug body 68 is fully inserted into the plug shell 66. Also, the strain relief members 118 and 120 will be held in intimate gripping contact with the cable by the camming action effected through engagement of the strain relief members with the tapered surface 74 of the plug housing cable passageway.

Figure 8:
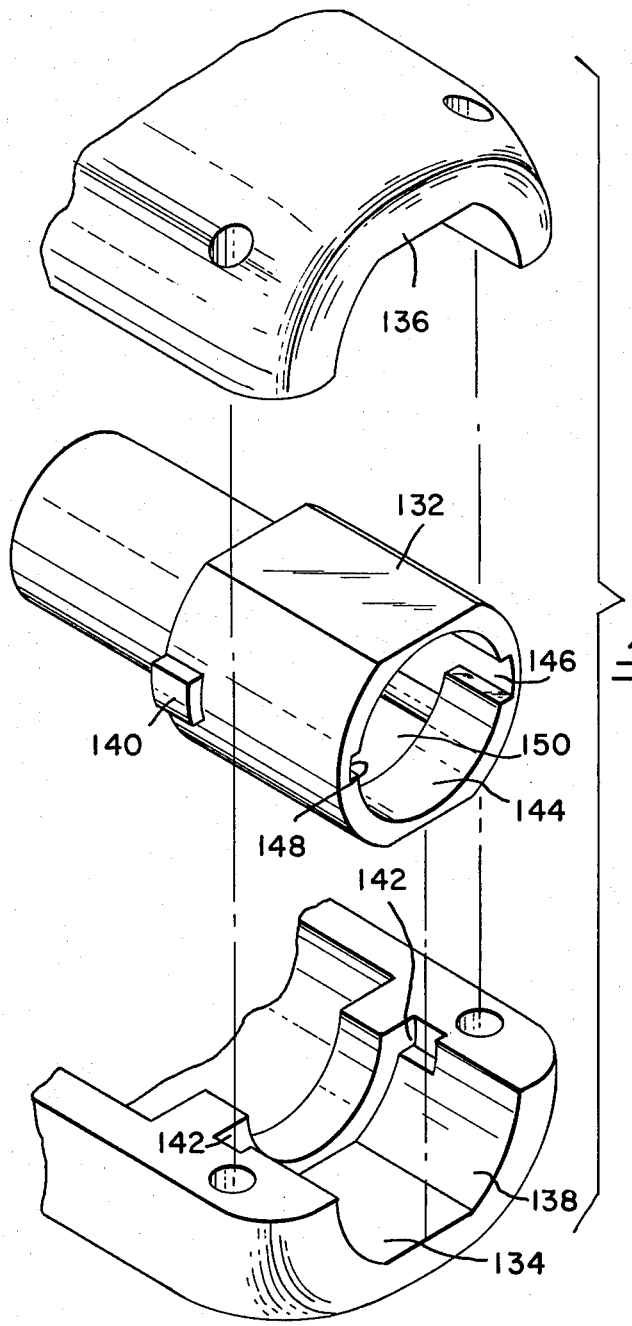
FIG. 8 is an exploded perspective view of the housing of an electrically operated device and an alternate drop-in embodiment of the receptacle member of the subject power cord connector.

FIG. 8 shows an alternate receptacle member, namely a drop-in receptacle member 132 which has an outer configuration adapted to be received in a profiled cavity 134 defined by housing portions 136, 138 of a well known device, such as an electrically powered hand drill. The drop-in receptacle member 132 has an outer profile which is received in the profiled cavity 134 with integral projections 140 mating in respective recesses 142 of the housing to secure the receptacle member 132 against both rotational and axial movement within the housing. The interior profile of the receptacle 132 is substantially identical to that of the previously described receptacle member and includes a blind, substantially cylindrical bore 144, diametrically opposed channels 146, 148 and locking recess 150. While the drop-in receptacle member 132 of FIG. 8 has been shown as a unitary molded member, clearly this could be a two-piece molded member for convenience in receiving the terminal pins therein.

A further alternate embodiment of the subject invention is the panel mounted receptacle member 152 shown in FIGS. 9 and 10. The receptacle member 152 has an interior profile adapted to receive the plug member 12 and includes a blind, substantially cylindrical bore 154 having a pair of diametrically opposed channels 156, 158, locking recesses 160 and detents 162. The exterior of the front portion 164 of receptacle member 152 is substantially cylindrical while the rear portion 166 is profiled to include a keying projection 168 and at least one locking lance 170. The panel 172 includes a profiled aperture 174 including a keying recess 176.

The receptacle member 152 is mounted in the panel 170 as shown in FIG. 10, and is accomplished in conventional manner. The keying projection 168 is aligned with the keying recess 176 and the rear portion 166 of the receptacle member 152 is pushed through aperture 174 until locking lances 170 engage the rear surface of the panel.

A sealing member 178 shown in FIGS. 11 and 12 is a generally cylindrical member 180 of resilient material having inwardly directed, annular flanges 182, 184 at the opposite ends thereof. Each of the flanges 182, 184 is provided with a plurality of annular, outwardly directed ridges 186, 188 respectively. The sealing member 178 is slipped over the front portion 164 of the receptacle member 152 with the ridges 186, 188 outwardly oriented. The receptacle member is mounted in panel 170, as previously described. The ridges 186 engage the panel face to provide an environmental tight seal therebetween. Likewise, when a plug member 12 is engaged in the receptacle member 152, the ridges 188 will form an environmental tight seal between the plug and receptacle members.

The present invention may be subject to many modifications and changes without departing from the spirit or essential characteristics thereof. The above-described embodiments are therefore to be considered in all respects as being illustrative and not restrictive of the scope of the invention.

What is claimed is:

1. A power cord connector for detachably engaging a power cord set with an electrically operated device comprising:

a receptacle member fixedly positioned within said device and including a profiled blind bore, at least one keying channel opening into and extending along substantially the entire length of said bore, a locking recess extending substantially normal to said keying channel about at least a portion of said bore, a locking detent fixed in said locking recess, and at least two electrical terminal pins fixedly extending from the blind end of said bore; and a plug member including:

a body member having at least two receptacle terminals mounted therein and matable with said terminal pins, at least two strain relief cable gripping means each attached to said body member by resilient arm means, at least one outwardly directed, integral keying projection adjacent one end of said body member, at least one outwardly directed, integral latching projection spaced along said body from said keying projection, and a substantially tubular housing member having a profiled outer configuration receivable in said profiled blind bore and a through passageway dimensioned to receive said plug body member therein, at least one slot in said housing member spaced from one end thereof and extending about at least a portion of the periphery thereof, said latching projection engaging said slot to limit the axial and rotational movement of said body member with respect to said housing member, and an integral outwardly directed locking projection adjacent said one end of said housing member which, upon relative rotation of said body member in said housing, is aligned with and displaced from said keying projection on said body member, whereby with said keying projection and said locking projection in alignment with each other and for insertion into said keying channel, said plug member is receivable in said receptacle member and is locked therein by relative rotation of said housing member with respect to said body member to engage said locking projection in said locking recess.

2. A power cord connector according to claim 1 wherein said plug housing member further comprises a radially directed flange integral with said plug housing member, said flange abutting said receptacle member upon mating therewith.

3. A power cord connector according to claim 1 wherein said plug housing member has a portion of its outer configuration profiled to facilitate gripping and rotation of said housing member.

4. A power cord connector according to claim 1 further comprising an O-ring of resilient sealing material mounted on said cord and engaging with a portion of said through passageway of said plug housing member to form a tight seal therewith.

5. A power cord connector according to claim 1 wherein said plug member further includes cord guard means integral with said housing member, said cord guard means comprising a tubular extension having a plurality of slots formed therein, said cord guard means limiting the bending of said cable adjacent said plug member thereby preventing overstressing of the cable.

6. A power cord connector according to claim 1 wherein said receptacle member is integral with said device.

7. A power cord connector according to claim 1 wherein said receptacle member is formed as a separate member with an outer profile mating with profiled recesses in said device.

8. A power cord connector according to claim 7 wherein said mating profiles of said receptacle member and said device include means preventing relative axial and rotational movement therebetween.

9. A power cord connector according to claim 1 wherein said receptacle member further comprises latching means for detachably mounting said receptacle member on a panel of said device.

10. A power cord connector according to claim 9 further comprising sealing means adapted to substantially encompass said receptacle and make sealing engagement between both said receptacle member and said panel and said receptacle member and said plug member.

11. A power cord connector according to claim 10 wherein said sealing means comprises:

a substantially cylindrical member of flexible sealing and insulating material having an integral inwardly directed annular flange on both ends thereof.

12. A power cord connector according to claim 11 wherein said annular flanges each include outwardly directed, compressable ridges for making sealing engagement.

13. A power cord connector according to claim 1 wherein said passageway in said plug housing member comprises:

a first cylindrical portion, a second cylindrical portion of lesser dimensions than said first cylindrical portion, and a truncated conical tapered portion joining said first and second portions, said cable strain relief means being driven into gripping engagement with said cable by said tapered portion.

14. A power cord connector according to claim 13 further comprising:

an O-ring of resilient sealing material mounted on said cord and making sealing engagement with said second cylindrical portion.

15. A power cord connector assembly for detachably connecting a power cord set to an electrically operated device, said connector comprising:

a receptacle member fixedly mounted in said device and including a blind, substantially cylindrical bore with at least one channel shaped keying recess extending the length thereof and opening into said bore, at least one locking recess extending substantially normal from said channel about a portion of said cylindrical bore, a detent in said locking recess, and at least two electrical contact terminals fixed extending from the blind end of said bore; and a plug member including a housing of insulative material having an outer profile receivable in said blind bore, a through passageway, at least one slot in said housing adjacent one end and extending about at least a portion of the periphery thereof, at least one outwardly directed locking flange integral with said housing and adjacent said one end, and a body dimensioned to be received in said through passageway and including at least a pair of contact terminals matable with said terminals in said receptacle member, a pair of cable clamping strain relief means attached to said member by a pair of resilient arms, outwardly directed keying means immediately adjacent one end of said body, and outwardly directed latching means spaced from said keying means and adapted to engage in said slot in said housing with said keying means abutting said one end, whereby limited relative rotational movement is possible between said plug body and said plug housing and said plug member is receivable in said blind bore, with said keying means and said locking flange both in alignment with each other and said keying channel and said plug member is locked therein by rotational movement of said housing to engage said locking flange in said locking recess.

16. A detachable power cord set in combination with an electric powered device including a housing having an electric motor disposed therein, means defining an exteriorly accessible opening in said housing, an electrical connector receptacle member fixed within said opening and having polarized blind bore with a plurality of terminal contacts mounted therein extending from the blind end thereof, said terminal contacts connected to energize said motor, and locking recess means in said bore, a power cord including a first plug member fixed to one end and adapted to be received in said receptacle member and a second plug member fixed to the other end and adapted to mate with a conventional power source, said first plug member comprising:

a body member having a like plurality of terminal contacts fixed therein to intermate with said plurality of terminal contacts in said receptacle member, at least two strain relief cable gripping means each attached to said body member by resilient arm means, at least one outwardly directed, polarizing projection adjacent one end of said body member, an outwardly directed, latching projection spaced along said body from said polarizing projection, and a substantially tubular housing member having a through passageway dimensioned to receive said plug body member therein, at least one slot in said housing member spaced from one end thereof and extending about at least a portion of the periphery thereof, said latching projection engaging said slot to limit the axial and rotational movement of said body member with respect to said housing member, and an integral locking projection adjacent said one end of said housing member which, upon relative rotation of said body member in said housing, is aligned with and displaced from said polarizing projection on said body member, whereby with said polarizing and locking projections in alignment with each other and said polarized blind bore, said plug member is receivable in said receptacle member and is locked therein by relative rotation of said housing member with respect to said body member.

* * * * *